United States Patent [19]

Nuckolls

[11] 3,931,543

[45] Jan. 6, 1976

[54] STARTING AND OPERATING CIRCUIT FOR GASEOUS DISCHARGE LAMPS

[75] Inventor: Joe A. Nuckolls, Hendersonville, N.C.

[73] Assignee: General Electric Company

[22] Filed: Sept. 30, 1974

[21] Appl. No.: 510,287

[52] U.S. Cl. ..... 315/177; 315/183; 315/231; 315/258; 315/324; 315/DIG. 2

[51] Int. Cl.[2] ..... H05B 41/14

[58] Field of Search ..... 315/258, 228, 231, 323, 315/324, 177, 183, DIG. 2, DIG. 5, 95, 97

[56] References Cited

UNITED STATES PATENTS

| | | | |
|---|---|---|---|
| 2,682,014 | 6/1954 | Feinberg | 315/231 |
| 2,686,906 | 8/1954 | Schevtchuk | 315/228 X |
| 2,760,118 | 8/1956 | Moerkens | 315/228 X |
| 3,235,769 | 2/1966 | Wattenbach | 315/176 |

*Primary Examiner*—Palmer C. Demeo
*Attorney, Agent, or Firm*—Sidney Greenberg

[57] ABSTRACT

Circuits are disclosed for starting and operating a high pressure sodium vapor lamp in combination with another gaseous discharge lamp of low voltage breakdown characteristics. The sodium vapor lamp is connected in series with a ballast induction coil, while the low voltage breakdown lamp, a portion of the ballast coil at its input side, and a capacitor are connected in a series discharge loop to produce high frequency, high voltage pulses for starting the sodium vapor lamp, and providing for operation of both lamps. A ballast capacitor is connected in series with the low voltage lamp to provide a lead ballast circuit therefor.

19 Claims, 7 Drawing Figures

STARTING AND OPERATING CIRCUIT FOR GASEOUS DISCHARGE LAMPS

The present invention relates to gaseous discharge lamp starting and operating circuits, and especially those including a discharge lamp requiring a starting voltage substantially higher than its operating voltage.

It is an object of the invention to provide a lighting system including a starting and operating circuit for a plurality of gaseous discharge lamps including a high voltage starting lamp wherein the circuit is simple, reliable and economical to manufacture.

It is a particular object of the invention to provide a lighting system of the above type which avoids light flicker in the composite illumination produced by the light sources.

Still another object of the invention is to provide a lighting system of the above type which provides for improved color of illumination, good operating efficiency, and long lamp life.

Another object of the invention is to provide a lighting system of the above type which is adapted to accommodate gaseous discharge lamps of widely differing operating voltages and other properties.

Other objects and advantages will become apparent from the following description and the appended claims.

With the above objects in view, the present invention in one of its aspects relates to a starting and operating circuit for gaseous discharge lamps, comprising, in combination, a source of alternating current, ballasting means including an induction coil connected at its input side to the alternating current source, the induction coil comprising an input portion and an output portion, a first gaseous discharge lamp having high voltage starting characteristics connected to the output side of the induction coil, a second gaseous discharge lamp having low voltage breakdown characteristics connected to the input portion of the induction coil, and a high frequency discharge capacitor connected to the second gaseous discharge lamp and the input coil portion and forming a series discharge loop therewith for providing high frequency, high voltage, low energy pulses for starting the first discharge lamp.

The invention will be better understood from the following description taken in conjunction with the accompanying drawings, in which.

Figure 1:
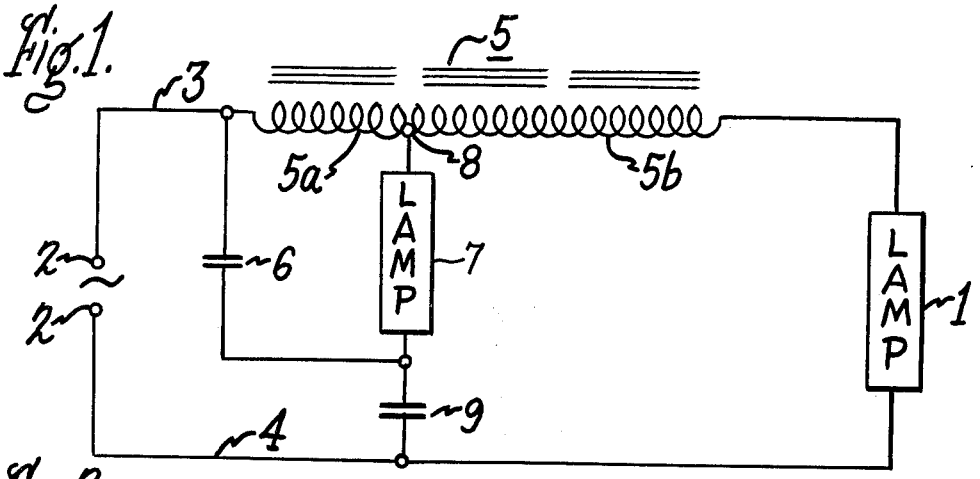
FIG. 1 is a circuit diagram showing an embodiment of the circuit of the invention for starting and operating a pair of high intensity gaseous discharge lamps, including lead and lag ballast circuits.

Referring now to the drawings, and particularly to FIG. 1, there is shown a lamp starting and operating circuit constructed in accordance with the invention and including lamp 1 such as a sodium or other type of vapor lamp, which requires a relatively high voltage, low energy pulse in order to be ignited and which thereafter operates at a lower voltage. Lamp 1, which is referred to herein generally as a high voltage starting lamp, is typically a high intensity gaseous discharge lamp of high pressure sodium vapor type, such as is available commercially under the registered trademark LUCALOX. Lamp 1 is connected by line conductors 3 and 4 across terminals 2 of an alternating current source, typically of 220 volts, with inductive reactance ballast 5 in the form of an iron core induction coil connected in series therewith to provide a current limiting impedance, as is conventional in discharge lamp circuits. Connected at the input side of ballast coil 5, in accordance with the invention, is lamp 7 which is typically a mercury vapor or metal halide gaseous discharge lamp of known type having a relatively low breakdown voltage, e.g., about 220 volts, and referred to herein generally as a low voltage breakdown lamp. In the illustrated embodiment, lamp 7 is connected at one side to a tap 8 on ballast coil 5 so as to divide the latter into an input portion 5*a* and an output portion 5*b*. High frequency discharge capacitor 6 is connected to the input side of coil 5 and the other side of lamp 7 so as to be arranged across the combination of coil turns 5*a* and lamp 7 as shown, and forming therewith a series discharge loop which serves to generate high voltage, low energy pulses for starting lamp 1 and to provide other functions as described below.

While the particular arrangement of capacitor 6 and lamp 7 as shown in FIG. 1 is preferred, it is contemplated in accordance with the invention that, where appropriate, the positions of these two components may be interchanged.

The number of turns tapped off in input coil portion 5*a* should be sufficient to completely couple in an autotransformer action the high voltage produced across the entire winding of ballast reactor 5. In a typical arrangement in the embodiment illustrated, the ratio of total turns to tapped turns may be about 15 to 1, which usually suffices to provide good coupling and adequate peak output voltage for starting lamp 1.

In the operation of the circuit thus described, capacitor 6 is initially charged by the input voltage from the alternating current source. As the voltage across capacitor 6 rises, it reaches the breakdown potential of lamp 7, so that the latter conducts current between its electrodes and becomes illuminated. When this occurs, capacitor 6 discharges through tapped turns 5*a* placing, say, 220 volts across those turns, resulting in a step-up by reactor coil 5 acting as an autotransformer to a voltage of, say, about 3000 volts which appears across the total turns of reactor 5. High frequency negative-going pulses of this high voltage level are thereby produced across lamp 1 by the pulse generating circuit described. The pulse voltage thus appears across discharge lamp 1 on each half cycle until lamp 1 starts. When lamp 1 starts and warms up to operating wattage, the high voltage pulses are dampened by the resistive loading effect of lamp 1, and lamp 7 continues to operate and provide illumination.

By virtue of arranging the high voltage starting circuit at the input side of ballast 5 and the use of a low voltage breakdown lamp 7 of high intensity discharge type, improved reliability and longer life of the circuit components are achieved as compared to arrangements where other forms of voltage breakdown switching means are employed.

Further, the described arrangement dispenses with the need for protective resistance or inductance components in the starting circuit since the high voltage generated thereby does not appear across the discharge network.

The described circuit permits relatively independent operation of the two gaseous discharge lamps, and in the event one or both lamps are extinguished due, for example, to a momentary drop in the source voltage, both lamps will re-start because the hot re-start recovery time for the low voltage breakdown lamp 7 typically used is always longer than that of lamp 1. It has also been found that if the operation of lamp 1 is interrupted for some reason, the operating high intensity discharge lamp 7 provides adequate pulsing for restarting the cooling lamp 1.

The provision of two lamps in the described circuit in accordance with the invention enables the use of mixed lamp illumination to produce the desired color merely by selecting a suitable combination from various types and wattages of known discharge lamps.

To enhance flicker-less operation of the two-lamp lighting system described, ballast capacitor 9 is preferably connected between line conductor 4 and the junction of capacitor 6 and lamp 7 as shown. As a result, lamp 7 is ballasted by a lead-type ballast whereas lamp 1 is ballasted by a lag-type ballast, so that the currents in the respective lamp circuits are out of phase, with the net effect of markedly reducing any composite light ripple on the work surfaces being illuminated by both lamps.

As will be evident, the high voltage generating circuit described serves a number of functions. It starts lamp 1, it aids in providing ballasting for both lamps 1 and 7, and it provides auxiliary illumination in the operation of lamp 7.

Figure 2:
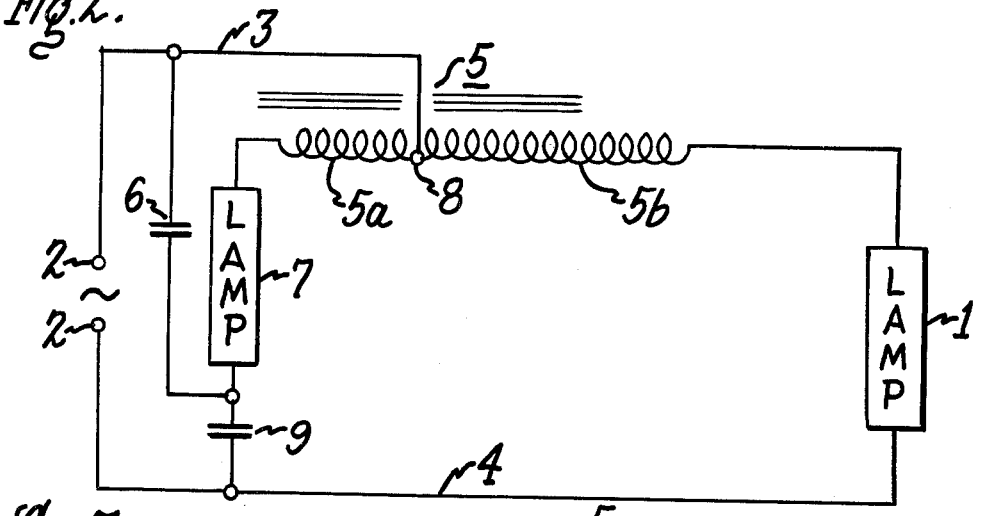
FIG. 2 is a circuit diagram showing a modification of the FIG. 1 circuit.

FIG. 2 shows a modification of the FIG. 1 circuit which may be employed to provide positive-going starting pulses on lamp 1 where the particular design or characteristics of the latter lamp makes this desirable. In this embodiment, lamp 7 is connected to the input lead of ballast coil 5 whereas high frequency discharge capacitor 6 is connected to tap 8 on coil 5. This circuit operates substantially in the same manner as that of FIG. 1, except that in contrast to the latter arrangement, the high voltage pulse will be initially positive-going across lamp 1 for the input sinewave instantaneously going positive.

Figure 3:
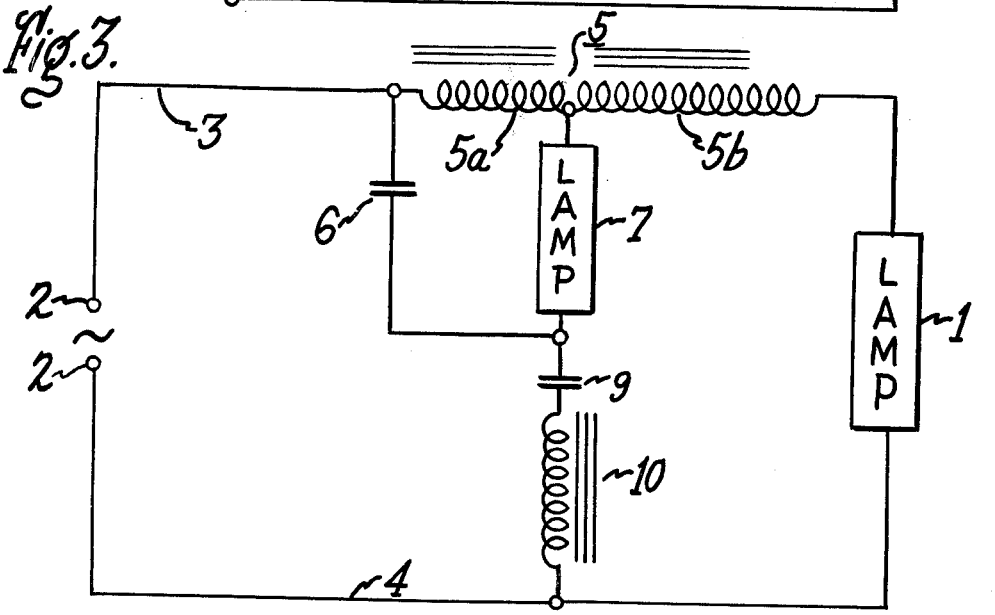
FIG. 3 is a circuit diagram similar to the FIG. 1 circuit incorporating an inductive reactance element in the lead ballast circuit.

FIG. 3 shows another modification of the FIG. 1 circuit wherein an induction coil 10 is arranged in series with lamp 7 as shown to provide additional inductive reactance for ballasting lamp 7, where this provision is necessary or desirable. The total inductive reactance for lamp 7 thus comprises input portion 5*a* of coil 5 and induction coil 10.

Figure 4:
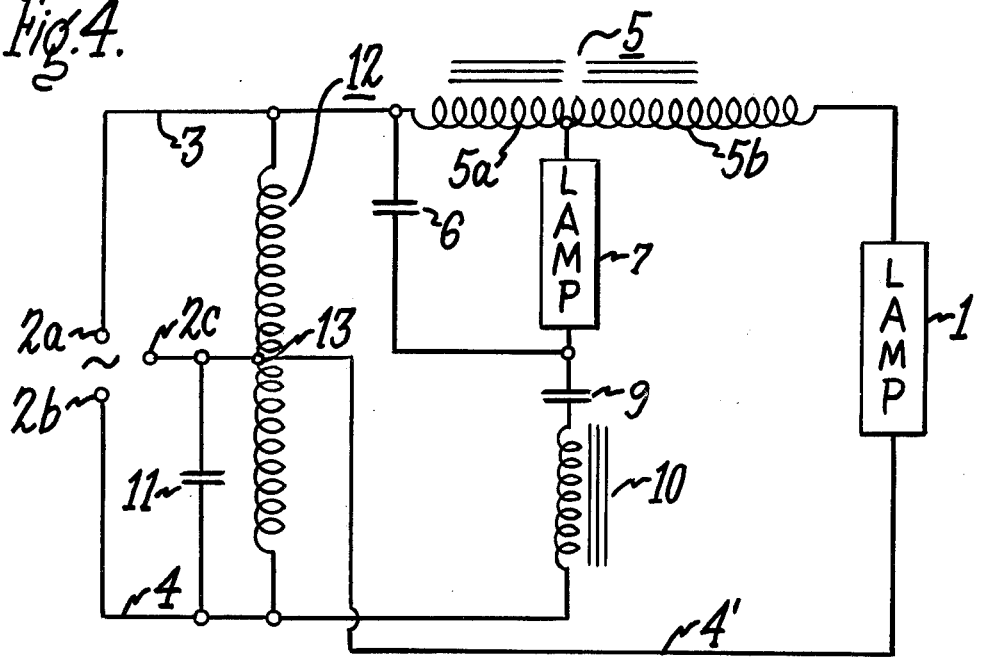
FIG. 4 is a circuit diagram of a modification of the FIG. 1 circuit adapted to accommodate gaseous discharge lamps of widely differing operating voltages.

FIG. 4 shows another embodiment of the circuit of the invention which is adapted for accommodating lamps having widely different operating voltages, as, for example, where lamp 1 is a 55 volt high pressure sodium vapor lamp and lamp 7 is a 135 volt mercury vapor lamp. In this circuit, autotransformer 12 is connected to line conductors 3 and 4 across supply terminals 2*a*, 2*b*, and another supply terminal 2*c* is connected to a tap 13 on autotransformer 12, with lamp 1 also connected to tap 13 as shown. When terminals 2*a*, 2*b* are connected to a 240 volt a-c supply, this voltage is available in the illustrated circuit for operating lamp 7, while autotransformer 12 serves to step down the voltage to, say, 120 volts for operating lamp 1. When terminals 2*b* and 2*c* are connected to a 120 volt a-c supply, this voltage is employed for operating lamp 1 by virtue of the circuit arrangement shown, while autotransformer 12 serves to step up this supply voltage for operating lamp 7.

Capacitor 11 connected between the lead to terminal 2*c* and line conductor 4 serves, when a 240 volt supply is used as described, to by-pass the inductive drop across the lower portion of autotransformer 12 as ignition pulses are applied to lamp 1. This avoids the possibility of undesired pulsing of the autotransformer windings.

Figure 5:
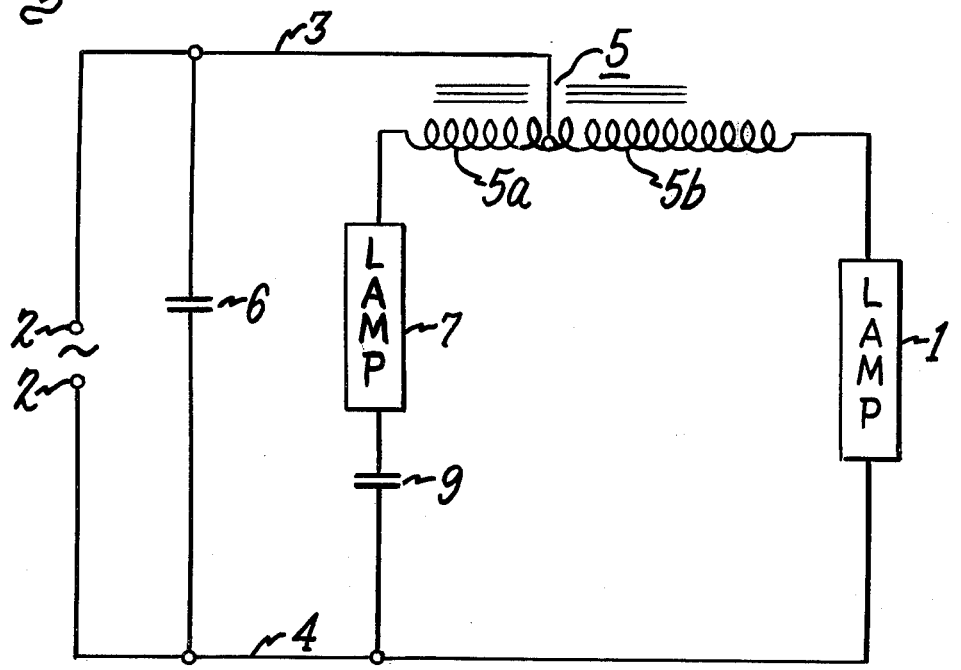
FIG. 5 is a circuit diagram showing modification of the FIG. 2 circuit having a different arrangement of the high voltage generating circuit.

FIG. 5 shows a modification of the circuit in FIG. 2, wherein high frequency discharge capacitor 6 is connected to line conductor 4, instead of to the junction of ballast capacitor 9 and lamp 7. In the FIG. 5 arrangement, the series discharge loop thus comprises input coil portion 5*a*, lamp 7, ballast capacitor 9, and high frequency by-pass capacitor 6. This arrangement provides a high frequency, low energy discharge loop for initial ionization of lamp 1 by action of the lamp 7 voltage collapsing from 220 to 20 volts, and, in addition, a higher energy component of voltage is maintained across lamp 1 as lamp 7 continues to draw RMS current through ballast capacitor 9. This higher energy voltage step-up across ballast coil 5 and applied to lamp 1 aids in providing the re-ignition peak voltage of lamp 1 on each half-cycle.

Figure 6:
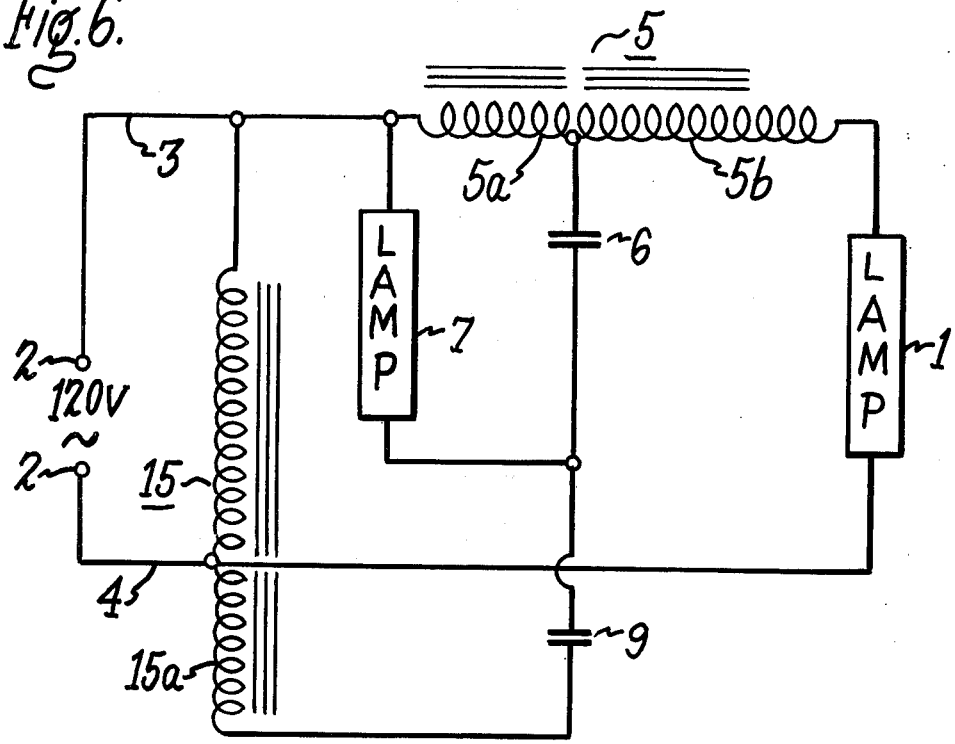
FIG. 6 shows a modification of the FIG. 4 circuit having an auxiliary induction coil forming a part of the autotransformer.

FIG. 6 shows a somewhat different embodiment of the circuit wherein an autotransformer 15 connected to the voltage supply is provided with an auxiliary winding 15*a* to serve as a portion of the ballast for lamp 7. In this circuit, the 120 volt supply conductor 4 and lamp 1 are connected to a tap on autotransformer 15, similar to the arrangement shown in FIG. 4, while lamp 7 is connected across the total turns of autotransformer 15 so that a stepped-up operating voltage may be applied thereto. The provision of an auxiliary coil winding 15*a*, as shown, magnetically coupled to autotransformer 15 serves to provide a higher open circuit voltage across lamp 7 to enable the use of a higher operating voltage lamp. While reactor ballast coil 5 is shown diagrammatically as a separate component in the illustrated circuit, it may in practice form a part of and be magnetically coupled to autotransformer 15, and thereby provide a higher operating RMS open circuit voltage for the particular type of lamp 1 employed, where this is desirable or necessary.

Figure 7:
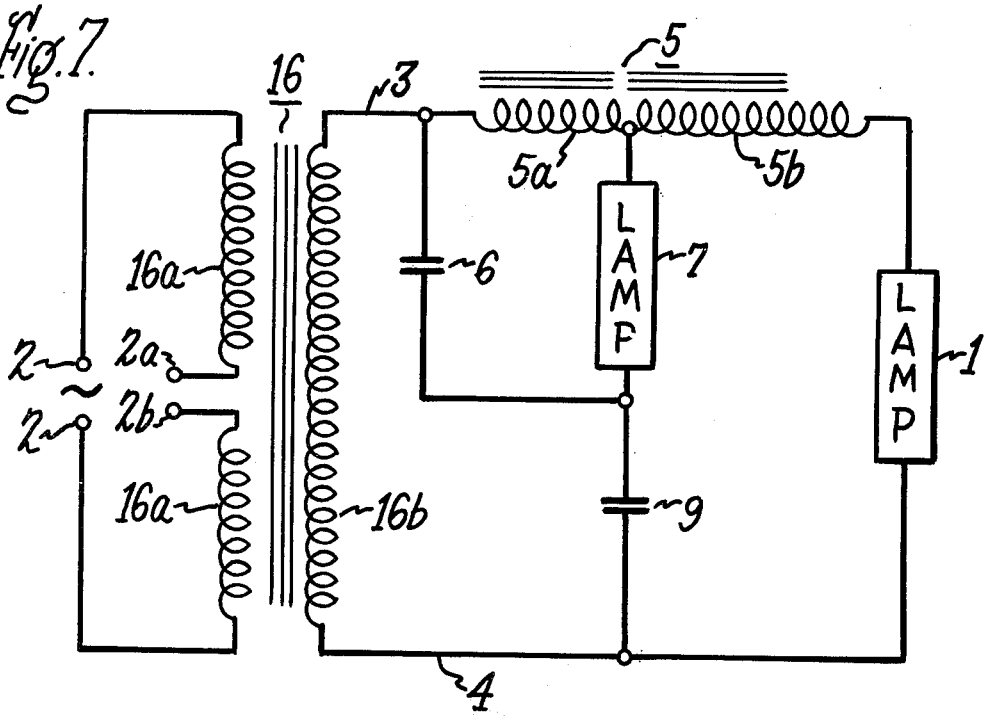
FIG. 7 shows an embodiment of the circuit of the invention incorporating an isolation transformer.

FIG. 7 shows an embodiment of the circuit wherein an isolation transformer is used to transform the supply voltage from the primary to the secondary to which the lamp circuits of the invention are connected. In the circuit illustrated, isolation transformer 16 has a primary 16*a* comprising two windings which are connected to terminals 2 of an alternating current supply and which may be alternatively interconnected in a manner well understood in the art to be either in series or in parallel to accommodate two different source voltages. Secondary winding 16*b* of transformer 16 is connected to reactor ballast 5 with associated high voltage pulse generating circuit as shown, it being understood that ballast coil 5 may, where desired, be magnetically coupled to secondary winding 16*b* as described in connection with the FIG. 6 circuit. Such a circuit may be employed, for example, where it is desired to electrically isolate the lamp sockets in the secondary from the primary voltage supply.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A starting and operating circuit for gaseous discharge lamps comprising, in combination, a source of alternating current, ballasting means including an induction coil connected at its input side to said alternating current source, said induction coil comprising an input portion and an output portion, a first gaseous discharge lamp having high voltage starting characteristics connected to the output side of said induction coil, a second gaseous discharge lamp having low voltage breakdown characteristics connected to the input portion of said induction coil, and a high frequency discharge capacitor connected across said second gaseous discharge lamp and said input coil portion and forming a series discharge loop therewith for providing high frequency, high voltage, low energy pulses for starting said first discharge lamp.

2. A circuit as defined in claim 1, including a ballast capacitor connected in series with said second gaseous discharge lamp.

3. A circuit as defined in claim 1, and auxiliary inductance means connected to said second gaseous discharge lamp in series therewith.

4. A circuit as defined in claim 1, said input and output portions of said ballast induction coil each having a predetermined number of coil turns, said ballast induction coil stepping up the voltage produced across said input portion by operation of said series discharge loop.

5. A circuit as defined in claim 1, including a tap on said induction coil dividing the same into said input and said output portions, one of said second gaseous discharge lamp and said high frequency discharge capacitor being connected to said tap and the other being connected to the input side of said induction coil.

6. A circuit as defined in claim 5, wherein said second gaseous discharge lamp is connected to said tap.

7. A circuit as defined in claim 5, wherein said high frequency discharge capacitor is connected to said tap.

8. A circuit as defined in claim 6, including a ballast capacitor connected in series with said second gaseous discharge lamp, said high frequency discharge capacitor being connected to the junction of said second gaseous discharge lamp and said ballast capacitor.

9. A circuit as defined in claim 2, said high frequency discharge capacitor being connected across said input coil portion, said second gaseous discharge lamp and said ballast capacitor and forming a series discharge loop therewith.

10. A circuit as defined in claim 1, including an autotransformer connected across said alternating current source at the input side of said induction coil, said first gaseous discharge lamp connected to said autotransformer intermediate its ends, said second gaseous discharge lamp being connected to opposite ends of said autotransformer.

11. A circuit as defined in claim 10, including ballast capacitance means and ballast inductance means connected in series with said second gaseous discharge lamp.

12. A circuit as defined in claim 11, said induction coil being magnetically coupled to said autotransformer.

13. A circuit as defined in claim 12, said ballast inductance means being magnetically coupled to said autotransformer.

14. A circuit as defined in claim 10, said second gaseous discharge lamp being connected to the input side of said induction coil.

15. A starting and operating circuit for gaseous discharge lamps comprising, in combination, a source of alternating current, ballasting means including an induction coil connected at its input side to said alternating current source, said induction coil comprising an input portion and an output portion, a first gaseous discharge lamp having high voltage starting characteristics connected to the output side of said induction coil, a second gaseous discharge lamp having low voltage breakdown characteristics connected to the input portion of said induction coil, and a high frequency discharge capacitor connected to said second gaseous discharge lamp and said input coil portion and forming a series discharge loop therewith for providing high frequency, high voltage, low energy pulses for starting said first discharge lamp, including an isolation transformer having a primary winding connected to said alternating current source and having a secondary winding connected to the input side of said induction coil and to said first gaseous discharge lamp.

16. A circuit as defined in claim 15, said second gaseous discharge lamp being connected to the junction of said induction coil and said secondary winding.

17. A circuit as defined in claim 16, said induction coil being magnetically coupled to said secondary winding.

18. A starting and operating circuit for gaseous discharge lamps comprising, in combination, a source of alternating current, ballasting means including an induction coil connected at its input side to said alternating current source, said induction coil comprising an input portion and an output portion, a first gaseous discharge lamp having high voltage starting characteristics connected to the output side of said induction coil, a second gaseous discharge lamp having low voltage breakdown characteristics connected to the input portion of said induction coil, and a high frequency discharge capacitor connected to said second gaseous discharge lamp and said input coil portion and forming a series discharge loop therewith for providing high frequency, high voltage, low energy pulses for starting said first discharge lamp, including an autotransformer connected across said alternating current source at the input side of said induction coil, said first gaseous discharge lamp connected to said autotransformer intermediate its ends, said second gaseous discharge lamp being connected to opposite ends of said autotransformer, and including means for alternatively connecting said autotransformer to current sources of different voltages.

19. A circuit as defined in claim 18, said connecting means comprising a pair of terminals respectively connected to opposite ends of said autotransformer and another terminal connected to said autotransformer intermediate its ends.

* * * * *